US009499967B2

(12) United States Patent
Defu

(10) Patent No.: US 9,499,967 B2
(45) Date of Patent: Nov. 22, 2016

(54) AIR SUCTION SPRAY NOZZLE

(71) Applicant: WDI (Xiamen) Technology Inc.

(72) Inventor: Chen Defu, Xiamen (CN)

(73) Assignee: WDI (XIAMEN) TECHNOLOGY INC., Xiamen (CN)

( * ) Notice: Subject to any disclaimer, the term of this patent is extended or adjusted under 35 U.S.C. 154(b) by 0 days.

(21) Appl. No.: 14/721,855

(22) Filed: May 26, 2015

(65) Prior Publication Data

US 2016/0053474 A1 Feb. 25, 2016

(30) Foreign Application Priority Data

May 27, 2014 (CN) ..... 2014 2 0276136 U

(51) Int. Cl.

| | |
|---|---|
| ***B05B 1/00*** | (2006.01) |
| ***E03D 9/08*** | (2006.01) |
| ***B05B 1/14*** | (2006.01) |
| ***B05B 7/04*** | (2006.01) |
| ***B05B 15/06*** | (2006.01) |

(52) U.S. Cl.

CPC . *E03D 9/08* (2013.01); *B05B 1/00* (2013.01); *B05B 1/14* (2013.01); *B05B 7/0425* (2013.01); *B05B 15/069* (2013.01)

(58) Field of Classification Search

CPC ..... E03D 9/08; B05B 1/00; B05B 15/069; B05B 7/0425; B05B 1/14

USPC ..... 239/589, 600, 601, 428.5, 104, 106

See application file for complete search history.

(56) References Cited

U.S. PATENT DOCUMENTS

2015/0076252 A1* 3/2015 Peteri ..... E03C 1/0404 239/428.5

* cited by examiner

*Primary Examiner* — Jason Boeckmann

(74) *Attorney, Agent, or Firm* — Walker & Jocke

(57) ABSTRACT

An air suction spray nozzle includes a spray pipe and a nozzle component. A spray pole at the end of the spray pipe is inserted to the nozzle component. The nozzle component includes a spray nozzle housing, a spray nozzle set and a rectifying core. One end of the spray nozzle housing is disposed with an open window. The spray nozzle housing is disposed with flushing holes at the area of the open window. The rectifying core is disposed between the spray pole and the flushing holes. The spray nozzle set is locked and assembled to the open window. Water sprays out of the outlet hole of the rectifying core from the spray pole, and then sprays out of the flushing holes. A vent cavity is disposed between the outlet hole and the flushing holes and is connected to the air through the clearance of the spray nozzle housing and the rectifying core and then through the open window.

20 Claims, 5 Drawing Sheets

AIR SUCTION SPRAY NOZZLE

CROSS-REFERENCE TO RELATED APPLICATIONS

This application claims priority to Chinese Patent Application No. 201420276136.0, filed May 27, 2014, has publication number CN 203905135 U, the disclosure of which is incorporated herein by reference in its entirety.

BACKGROUND

In the present market, the flushing cover is usually disposed with one or two spray nozzles to wash privates of the human body. This kind of spray nozzle has a simple structure and a single function, but it has a disadvantage when used. Specifically, the flushing force depends on the water pressure, and the flushing force is strong to hurt the skin when under a large water pressure. So, it needs to be improved to solve this disadvantage.

SUMMARY

The object of the present application is to overcome the disadvantage of the existing technology by providing an air suction spray nozzle that can generate bubble water automatically.

An exemplary embodiment of an air suction spray nozzle includes a spray pipe and a nozzle component. A spray pole at the end of the spray pipe is inserted into the nozzle component. The nozzle component includes a spray nozzle housing, a spray nozzle set and a rectifying core. One end of the spray nozzle housing is disposed with an open window. The spray nozzle housing is disposed with flushing holes at the area of the open window. The rectifying core is disposed between the spray pole and the flushing holes. The spray nozzle set is locked and assembled to the open window. Water sprays out of the outlet hole of the rectifying core from the spray pole, and then sprays out of the flushing holes. A vent cavity is disposed between the outlet hole and the flushing holes. The vent cavity is connected to the air through the clearance of the spray nozzle housing and the rectifying core and then through the open window.

In another exemplary embodiment, the rectifying core includes a water cavity and a rectifying cavity. The water cavity is disposed with an injection hole. The injection hole is connected to the spray pole. The rectifying cavity is a flat cavity. The water cavity is connected to one end of the rectifying cavity. The other end of the rectifying cavity is disposed with the outlet hole.

In another exemplary embodiment, one end of the inner cavity of the spray nozzle housing is disposed with a step protruding inwardly. A portion of the water cavity of the rectifying core higher than the rectifying cavity abuts against the step. The distance from the step to the end of the inner cavity of the spray nozzle housing is larger than the length of the rectifying cavity extending out of the water cavity. A vent hole is formed between the end portion of the rectifying cavity and the end of the inner cavity of the spray nozzle housing.

In another exemplary embodiment, the flushing hole is disposed between the step and the end of the inner cavity of the spray nozzle housing.

In another exemplary embodiment, the top surface of the rectifying cavity and the inner surface of the spray nozzle housing have a clearance with a certain height to form the vent cavity. The vent cavity is connected to the air by the vent hole.

In another exemplary embodiment, the top surface of the rectifying cavity is disposed with a jacking sheet protruding upwardly. The jacking sheet abuts against the inner surface of the spray nozzle housing.

In another exemplary embodiment, the spray nozzle housing and the rectifying core have assembly clearances at the two sides of the open window. The spray nozzle set is inserted to the assembly clearance. The spray nozzle set has enough length to cover the rectifying core, and the spray nozzle set is shorter than the length of the open window. The spray nozzle set and the spray nozzle housing have clearance at the outer side of the open window to form a suction groove to connect to the vent hole.

In another exemplary embodiment, the suction groove is an elongated slot. In another exemplary embodiment, the top surface of the water cavity is disposed with a concave anti-rotation groove in the axial direction. The inner cavity of the spray nozzle housing is disposed with anti-rotation rib according to the anti-rotation groove. The anti-rotation rib fits to the anti-rotation groove.

In another exemplary embodiment, the flushing holes are conical holes with bottom surface orientation. The bottom diameter of the flushing hole is larger than the outlet hole. The flushing holes face the outlet hole.

In another exemplary embodiment, the area of the outer surface of the spray nozzle housing at the flushing holes is a boss. The flushing holes are disposed on the top surface of the boss. In another exemplary embodiment, the front end of the spray nozzle housing is disposed with at least a lock groove. The outer surface of the spray pole is disposed with a lock rib corresponding to the lock groove. The lock groove is locked to the lock rib in fitting way.

DETAILED DESCRIPTION

The present application will be further described with the drawings and the embodiments.

Figure 1:
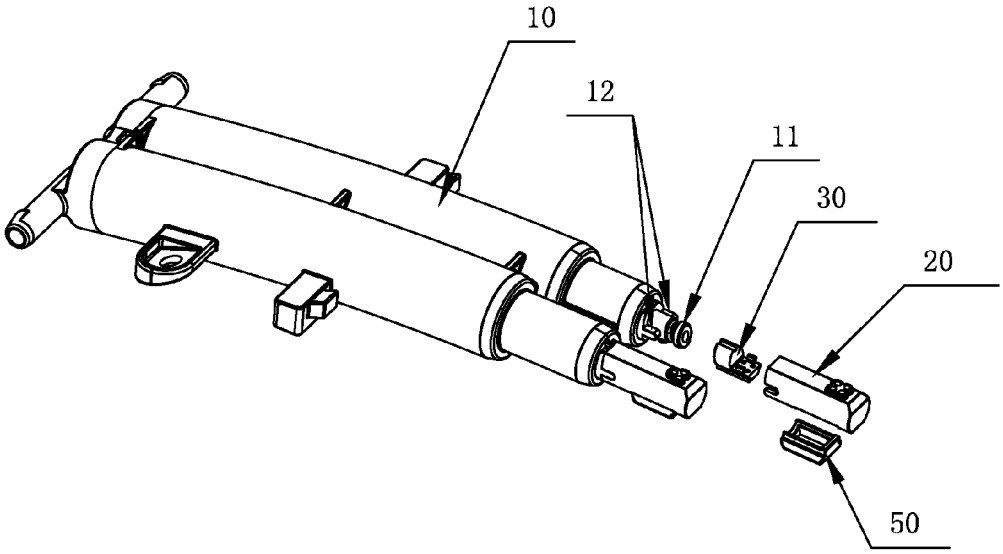
FIG. 1 illustrates a schematic diagram of an exemplary embodiment of an air suction spray nozzle.
Figure 2:
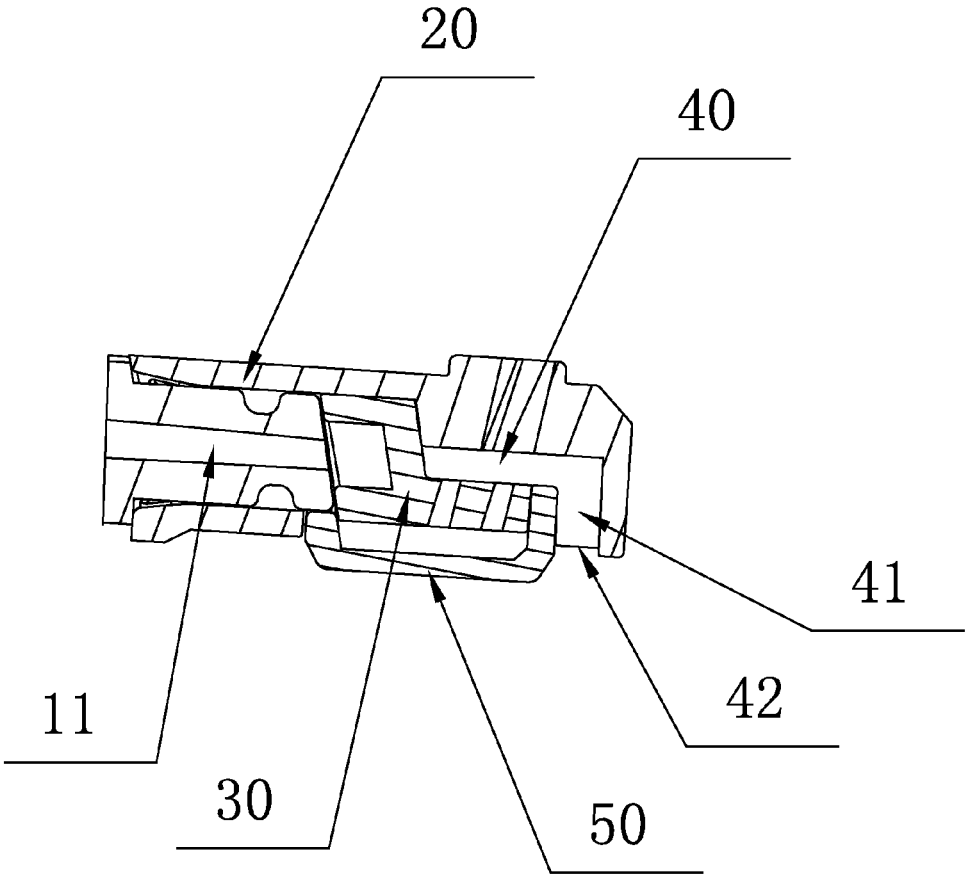
FIG. 2 illustrates a section diagram of the spray nozzle component.
Figure 3:
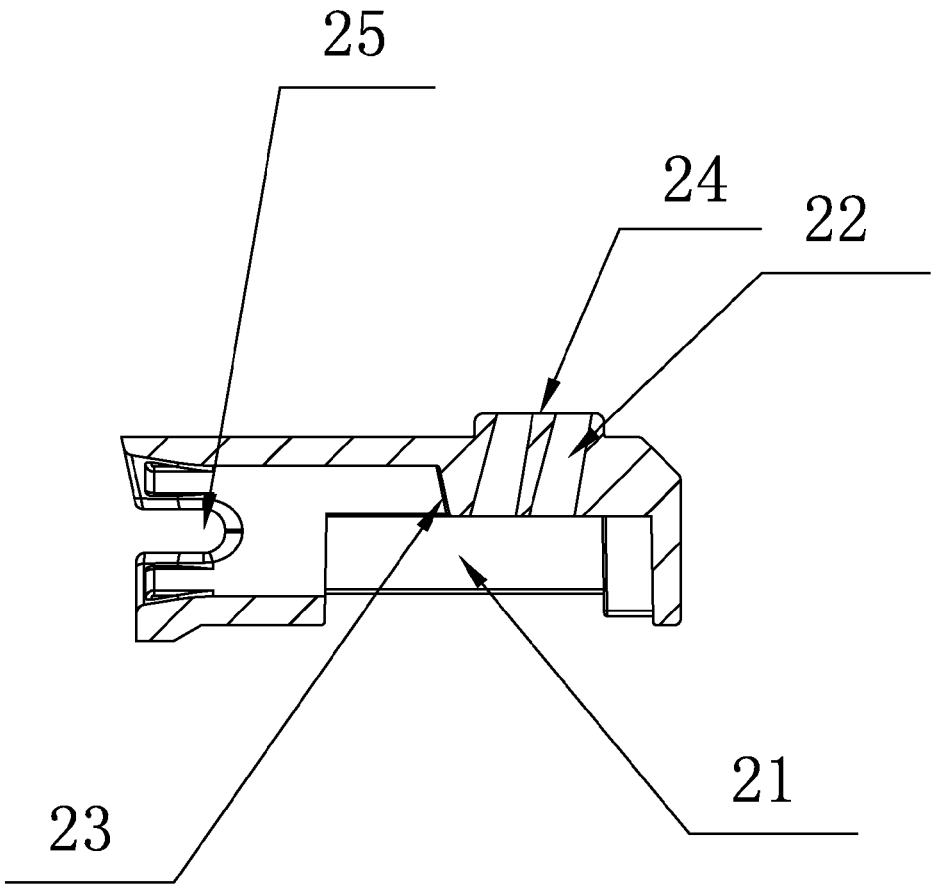
FIG. 3 illustrates a section diagram of the spray nozzle housing.
Figure 4:
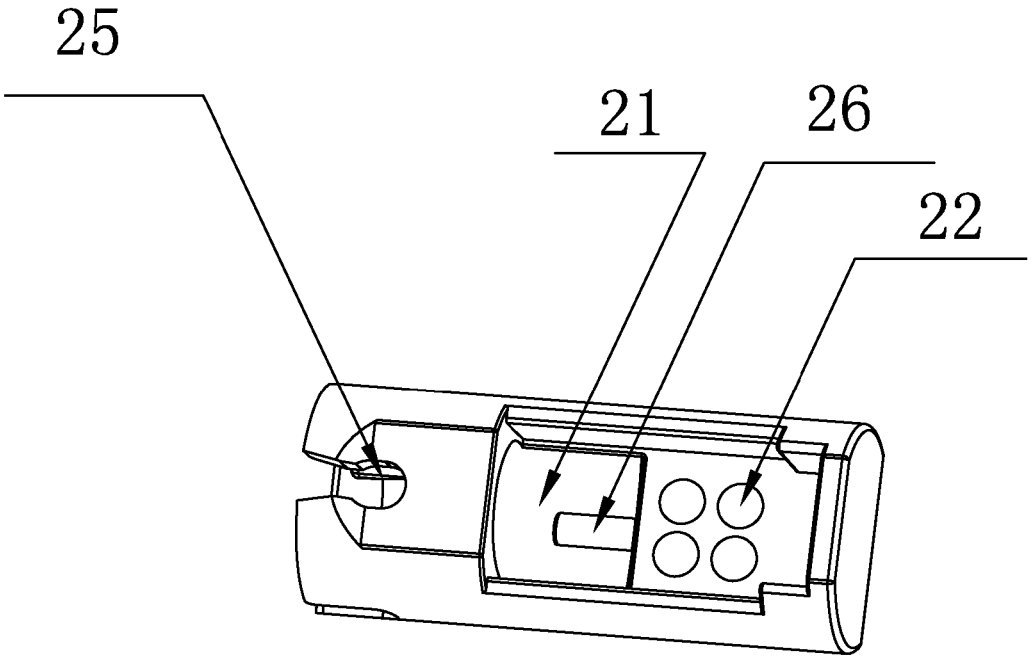
FIG. 4 illustrates a schematic diagram of the spray nozzle housing from the bottom view.
Figure 5:
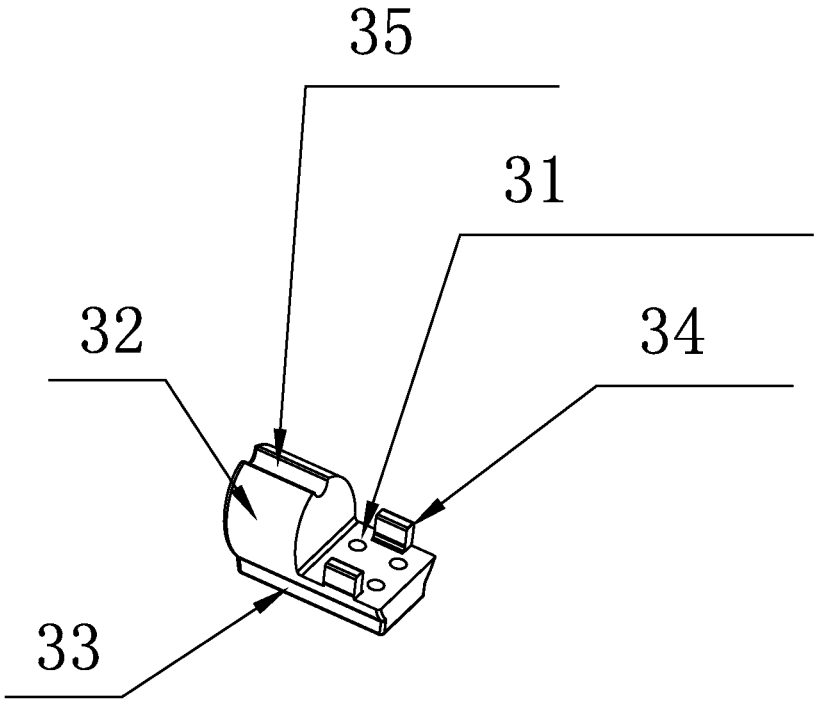
FIG. 5 illustrates a schematic diagram of the rectifying core.

An air suction spray nozzle, as shown in FIG. 1, comprises a spray pipe 10 and a spray nozzle component. A spray pole 11 at one end of the spray pipe 10 is inserted into the spray nozzle component to supply water to the spray nozzle component.

As shown in FIGS. 2-5, the spray nozzle component comprises a spray nozzle housing 20, a spray nozzle set 50, and a rectifying core 30. One side of the end of the spray nozzle housing 20 is disposed with an open window 21. The spray nozzle housing 20 is disposed with flushing holes 22 at the position of the open window 21. The rectifying core 30 is disposed between the spray pole 11 and the flushing holes 22. The spray nozzle set 50 is locked to the open window 21. Flowing water sprays out of the flushing holes 22 through the outlet hole 31 of the rectifying core 30 from the spray pole 11. In this embodiment, the flushing holes are conical holes with a bottom surface orientation. The bottom surface diameter of the flushing hole is larger than the outlet hole 31. The flushing holes 22 are disposed facing the outlet hole 31. That is to say, the outlet hole 31 of the rectifying core 30 is aligned to the axis of the flushing holes 22 of the spray nozzle housing 20. A vent cavity 40 is disposed between the outlet hole 31 and the flushing holes 22. The vent cavity 40 is connected to the air by the clearance of the spray nozzle housing and the rectifying core 30 and then by the open window.

In this exemplary embodiment, the rectifying core 30 comprises a water cavity 32 and a rectifying cavity 33. The water cavity 32 is disposed with a water injection hole. The water injection hole is connected to the spray pole 11. The rectifying cavity 33 is a flat cavity. The water cavity 32 is connected to one end of the rectifying cavity 33. The other end of the rectifying cavity 33 is disposed with the outlet hole 31. In this embodiment, the inner cavity of the spray nozzle housing 20 is a drum shaped cavity. The water cavity is a circular cavity coupled to the inner cavity of the spray nozzle housing 20. The rectifying cavity 33 is a flatform cavity. The water cavity 32 is vertically connected to one end of the rectifying cavity 33. The outlet hole 31 is disposed on the top surface of the other end of the rectifying cavity 33.

To avoid the rectifying core 30 inserting to the inner cavity of the spray nozzle housing 30 deeply thus closing the vent hole 41, it needs a limit device to limit the assembly route of the rectifying core 30. In this embodiment, one end of the inner cavity of the spray nozzle housing 20 is disposed with a step 23 protruding inwardly. The portion of the water cavity 32 of the rectifying core 30 higher than the rectifying cavity 33 abuts against the step 23. The distance from the step 23 to the end of the inner cavity of the spray nozzle housing 20 is larger than the length of the rectifying cavity 33 extending out of the water cavity 32. The end portion of the rectifying cavity 33 and the end of the inner cavity of the spray nozzle housing 20 form the vent hole 41. To guarantee the water outflow and the water volume, the flushing holes 22 are disposed between the step 23 and the end of the inner cavity of the spray nozzle housing 20. That is to say, the flushing holes are disposed in the area of the vent cavity 40 to hold the outlet of the rectifying core 30. The direction of the flushing holes 22 can be disposed at the top surface or the side surfaces of the spray nozzle housing 20 according to different requirements of the products.

Based on the rectifying cavity, the vent cavity 40 of this embodiment can be formed such that the top surface of the rectifying cavity 33 and the inner surface of the spray nozzle housing 20 have a clearance with certain height to form the vent cavity 40. The vent cavity 40 is connected to the air by the vent hole 41. The vent cavity 40 doesn't need to be specially configured. It can be surrounded by the rectifying core 30 and the spray nozzle housing 20. The structure is simple and the assembly is convenient. To make the rectifying core 30 stably disposed in the spray nozzle housing 20 and to avoid leakage due to shakes, the top surface of the rectifying cavity 33 is disposed with jacking sheet 34 protruding upwardly. The jacking sheet 34 abuts against the inner surface of the spray nozzle housing 20, so that the rectifying core 30 cannot move up and down, thus making the structure more compact.

The spray nozzle housing 20 and the rectifying core 30 have assembly clearance at the two sides of the open window 21. The spray nozzle set 50 is inserted into the assembly clearance. The spray nozzle set 50 is fixedly connected to the spray nozzle housing 20 by ultrasonic welding or adhesive.

The spray nozzle set 50 is configured, so that it can totally hold the rectifying core 30 but it cannot close the vent hole 41. The spray nozzle set 50 has enough length to cover the rectifying core 30 and the length is shorter than the length of the open window 21. The spray nozzle set 40 and the spray nozzle housing 20 have clearance at the outer side of the open window 21 and form the suction groove 42 to connect to the vent hole 41. To realize larger suction volume, the suction groove 42 is an elongated slot. For different products, the suction groove 42 can be made in different shapes. The suction volume is controllable by the size and the shape of the suction groove 42, so that the air holdup of the bubble water is controllable. In other cases, an adjusting slide sheet can be disposed to change the size and shape of the suction groove 42.

For well outflow water, the outlet hole 31 of the rectifying core 30 and the flushing holes 22 of the spray nozzle housing 20 are guaranteed to connect to the vent cavity 40, so that it must avoid the rectifying core 30 changing its position that leads to position deviation of the outlet hole 31. The exemplary embodiment is provided with an anti-rotation and positioning device. In this exemplary embodiment, the top surface of the water cavity 32 is disposed with a concave anti-rotation groove 35 in the axial direction. The surface of the inner cavity of the spray nozzle housing 20 is disposed with an anti-rotation rib 26 corresponding to the anti-rotation groove 35. The anti-rotation rib 26 fits to the anti-rotation groove.

The outer surface of the spray nozzle housing 20 is disposed with a boss 24 with a certain height at the area of the flushing holes 22, the flushing holes 22 are disposed in the top surface of the boss 24. To avoid the outflow direction offsetting due to the change of the direction of the spray nozzle components, in this embodiment, the front end of the spray nozzle housing 20 is disposed with at least a lock groove 25. The outer surface of the spray pole 11 is disposed with lock rib 12 corresponding to the lock groove 25. The lock groove 25 fits to the lock rib 12 to avoid rotating of the spray nozzle component.

When assembling, the rectifying core 30 is put into the cavity of the spray nozzle housing 20. The anti-rotation groove 35 of the rectifying core 30 fits to the anti-rotation rib 26 of the spray nozzle housing 20 to avoid rotating. The jacking sheet 34 of the rectifying core 30 abuts against the inner surface of the spray nozzle housing 20. The spray nozzle set 50 is then locked to the clearance of the spray nozzle housing 20 and the rectifying core 30. The spray nozzle housing 20 and the spray nozzle set 50 are then pressed tightly. The fitting surface of the spray nozzle housing 20 and the spray nozzle set 50 has an ultrasonic welding line. The spray nozzle housing 20 is fixedly connected to the spray nozzle set 50 by ultrasonic welding. The spray pole 11 is assembled to the spray nozzle housing 20 from the front end. The spray pole 11 is sealed by an O ring. The front end of the spray nozzle housing 20 is disposed with a lock groove 25 to lock to the lock rib 12 of the spray pole 11.

The exemplary embodiments have the following advantages. The air suction spray nozzle of the present invention is provided such that bubble water is generated by the suction hole of the spray nozzle to intake air during flushing water. The amount of bubble can break up the flushing water so as to ease the pain, so that it improves the comfort effect. In addition, the bubble breaks up water and enlarges the flushing area, so that it obtains cleaner flushing. The present application can be applied in a flushing cover with a bottom wash or women's private parts wash. It can reduce the impact of the water and improve the comfort effect. It also enlarges the flushing area to obtain cleaner flushing.

Although the present application has been described with reference to the preferred embodiments thereof for carrying out the patent for invention, it is apparent to those skilled in the art that a variety of modifications and changes may be made without departing from the scope of the patent for invention which is intended to be defined by the appended claims.

I claim:

1. An air suction spray nozzle comprising:

a spray pipe;

a nozzle component, wherein the nozzle component comprises a spray nozzle housing, a spray nozzle set and a rectifying core, wherein one end of the spray nozzle housing is disposed with an open window, wherein the spray nozzle housing is disposed with flushing holes at the area of the open window; and a spray pole, wherein the spray pole is at the end of the spray pipe, wherein the spray pole is inserted to the nozzle component, wherein the rectifying core is disposed between the spray pole and the flushing holes, wherein the spray nozzle set is locked and assembled to the open window, wherein the rectifying core includes an outlet hole, wherein water sprays out of the outlet hole of the rectifying core from the spray pole, and then sprays out of the flushing holes, wherein a vent cavity is disposed between the outlet hole and the flushing holes, wherein the vent cavity is connected to the air through the clearance of the spray nozzle housing and the rectifying core and then through the open window, wherein the spray nozzle housing and the rectifying core have assembly clearances at the two sides of the open window, wherein the spray nozzle set is inserted to the assembly clearance, wherein the spray nozzle set has enough length to cover the rectifying core, wherein the spray nozzle set is shorter than the length of the open window, wherein the spray nozzle set and the spray nozzle housing have clearance at an outer side of the open window to form a suction groove to connect to the vent hole.

2. The air suction spray nozzle according to claim 1, wherein the rectifying core comprises a water cavity and a rectifying cavity, wherein the water cavity is disposed with an injection hole, wherein the injection hole is connected to the spray pole, wherein the rectifying cavity is a flat cavity, wherein the water cavity is connected to one end of the rectifying cavity, wherein the other end of the rectifying cavity is disposed with the outlet hole.

3. The air suction spray nozzle according to claim 2, wherein one end of an inner cavity of the spray nozzle housing is disposed with a step protruding inwardly, wherein a portion of the water cavity of the rectifying core higher than the rectifying cavity abuts against the step, wherein the distance from the step to the end of the inner cavity of the spray nozzle housing is larger than the length of the rectifying cavity extending out of the water cavity, wherein a vent hole is formed between the end portion of the rectifying cavity and the end of the inner cavity of the spray nozzle housing.

4. The air suction spray nozzle according to claim 3, wherein the flushing hole is disposed between the step and the end of the inner cavity of the spray nozzle housing.

5. The air suction spray nozzle according to claim 3, wherein a top surface of the rectifying cavity and an inner surface of the spray nozzle housing have a clearance with certain height to form the vent cavity, wherein the vent cavity is connected to the air by the vent hole.

6. The air suction spray nozzle according to claim 5, wherein the top surface of the rectifying cavity is disposed with a jacking sheet protruding upwardly, wherein the jacking sheet abuts against the inner surface of the spray nozzle housing.

7. The air suction spray nozzle according to claim 1, wherein the suction groove is an elongated slot.

8. The air suction spray nozzle according to claim 2, wherein a top surface of the water cavity is disposed with a concave anti-rotation groove in the axial direction, wherein the inner cavity of the spray nozzle housing is disposed with an anti-rotation rib corresponding to the anti-rotation groove, wherein the anti-rotation rib fits into the anti-rotation groove.

9. The air suction spray nozzle according to claim 1, wherein the flushing holes are conical holes with bottom surface orientation, wherein a bottom diameter of the flushing hole is larger than the outlet hole, wherein the flushing holes face the outlet hole.

10. The air suction spray nozzle according to claim 1, wherein an area of an outer surface of the spray nozzle housing at the flushing holes is a protrude part, the flushing holes are disposed on the top surface of the protrude part.

11. The air suction spray nozzle according to claim 1, wherein a front end of the spray nozzle housing is disposed with at least a lock groove, wherein an outer surface of the spray pole is disposed with a lock rib corresponding to the lock groove, wherein the lock groove is locked to the lock rib in fitting way.

12. An air suction spray nozzle comprising:

a spray pipe;

a nozzle component, wherein the nozzle component comprises a spray nozzle housing, a spray nozzle set and a rectifying core, wherein one end of the spray nozzle housing is disposed with an open window, wherein the spray nozzle housing is disposed with flushing holes at the area of the open window; and a spray pole, wherein the spray pole is at the end of the spray pipe, wherein the spray pole is inserted to the nozzle component, wherein the rectifying core is disposed between the spray pole and the flushing holes, wherein the spray nozzle set is locked and assembled to the open window, wherein the rectifying core includes an outlet hole, wherein water sprays out of the outlet hole of the rectifying core from the spray pole, and then sprays out of the flushing holes, wherein a vent cavity is disposed between the outlet hole and the flushing holes, wherein the vent cavity is connected to the air through the clearance of the spray nozzle housing and the rectifying core and then through the open window, wherein the rectifying core comprises a rectifying cavity, wherein the top surface of the rectifying cavity is disposed with a jacking sheet protruding upwardly, wherein the jacking sheet abuts against the inner surface of the spray nozzle housing.

13. The air suction spray nozzle according to claim 12, wherein the rectifying core comprises a water cavity, wherein the water cavity is disposed with an injection hole, wherein the injection hole is connected to the spray pole, wherein the rectifying cavity is a flat cavity, wherein the water cavity is connected to one end of the rectifying cavity, wherein the other end of the rectifying cavity is disposed with the outlet hole.

14. The air suction spray nozzle according to claim 13, wherein one end of an inner cavity of the spray nozzle housing is disposed with a step protruding inwardly, wherein a portion of the water cavity of the rectifying core higher than the rectifying cavity abuts against the step, wherein the distance from the step to the end of the inner cavity of the spray nozzle housing is larger than the length of the rectifying cavity extending out of the water cavity, wherein a vent hole is formed between the end portion of the rectifying cavity and the end of the inner cavity of the spray nozzle housing.

15. The air suction spray nozzle according to claim 14, wherein the flushing hole is disposed between the step and the end of the inner cavity of the spray nozzle housing.

16. The air suction spray nozzle according to claim 14, wherein a top surface of the rectifying cavity and an inner surface of the spray nozzle housing have a clearance with certain height to form the vent cavity, wherein the vent cavity is connected to the air by the vent hole.

17. The air suction spray nozzle according to claim 13, wherein a top surface of the water cavity is disposed with a concave anti-rotation groove in the axial direction, wherein the inner cavity of the spray nozzle housing is disposed with an anti-rotation rib corresponding to the anti-rotation groove, wherein the anti-rotation rib fits into the anti-rotation groove.

18. The air suction spray nozzle according to claim 12, wherein the flushing holes are conical holes with bottom surface orientation, wherein a bottom diameter of the flushing hole is larger than the outlet hole, wherein the flushing holes face the outlet hole.

19. The air suction spray nozzle according to claim 12, wherein an area of an outer surface of the spray nozzle housing at the flushing holes is a protrude part, the flushing holes are disposed on the top surface of the protrude part.

20. An air suction spray nozzle comprising:

a spray pipe configured to deliver water therefrom, a spray pole, wherein the spray pole extends at an end of the spray pipe and is in fluid connection therewith, a nozzle component including a spray nozzle housing, wherein the housing includes a window to an interior area within the housing, wherein the window extends on a first side of the housing, a plurality of flushing holes, wherein the flushing holes extend through the housing from the interior area to a second side of the housing opposite the first side, a rectifying core, wherein the rectifying core extends in the interior area and in interior underlying relation of a portion of the window, wherein the rectifying core includes at least one outlet hole, wherein the at least one outlet hole is in fluid connection with the spray pole and is open to a cavity in the interior area and is in spaced away directionally aligned relation with the plurality of flushing holes, a nozzle set, wherein the nozzle set outwardly overlies and operatively engagingly holds the rectifying core in fixed relation relative to the housing, wherein the nozzle set partially fluidly closes the window such that a vent hole enabling air to flow from atmosphere to the cavity remains open through the window, wherein water delivered by the spray pipe is operative to enter the spray pole and nozzle housing and pass through the at least one outlet hole in the rectifying core to the cavity, mix with air in the cavity that is drawn into the cavity through the vent hole, and pass as bubble water out of the plurality of flushing holes of the housing.

* * * * *